United States Patent [19]

Hanlon

[11] Patent Number: 4,482,355

[45] Date of Patent: Nov. 13, 1984

[54] DIESEL FUEL COMPOSITIONS

[75] Inventor: J. Vincent Hanlon, Baton Rouge, La.

[73] Assignee: Ethyl Corporation, Richmond, Va.

[21] Appl. No.: 567,071

[22] Filed: Dec. 30, 1983

[51] Int. Cl.[3] ..... C10L 1/22

[52] U.S. Cl. ..... 44/57; 44/71; 44/72

[58] Field of Search ..... 44/57, 71, 72

[56] References Cited

U.S. PATENT DOCUMENTS

| | | | |
|---|---|---|---|
| 2,280,217 | 4/1942 | Cloud | 44/57 |
| 2,945,749 | 7/1960 | Andress, Jr. | 44/72 |
| 3,490,882 | 1/1970 | Dunworth | 44/72 |

*Primary Examiner*—Mrs. Y. Harris-Smith

*Attorney, Agent, or Firm*—Donald L. Johnson; John F. Sieberth; Willard G. Montgomery

[57] ABSTRACT

Coking in and around the injector nozzles of indirect injection compression ignition engines is reduced by means of distillate fuel with which has been blended suitable concentrations of:

(a) organic nitrate ignition accelerator, (b) hydrocarbyl amine having from 3 to 60 carbons and from 1 to 10 nitrogens, and (c) N,N'-disalicylidene-1,2-diaminopropane.

Also described are additive mixtures of (a), (b), and (c) for use in distillate fuels in amounts sufficient to reduce the coking tendencies of such fuels when used in the operation of indirect injection compression ignition engines.

12 Claims, 1 Drawing Figure

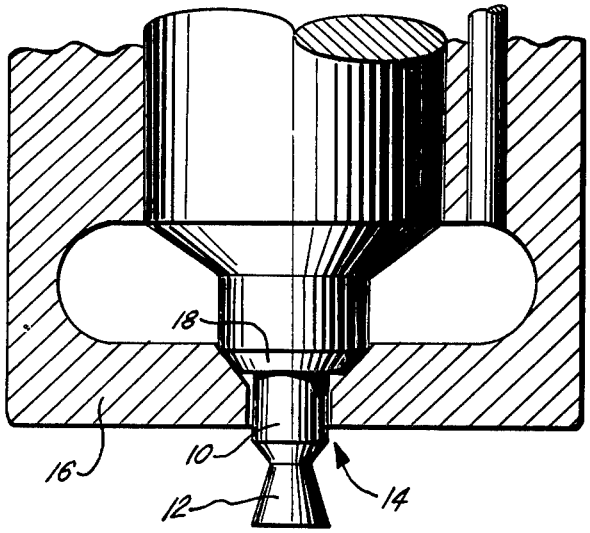
18
16
10
12
14

DIESEL FUEL COMPOSITIONS

FIELD

Compression ignition fuel compositions and additive mixtures of organic nitrate ignition accelerator, hydrocarbyl amine and N,N'-disalicylidene-1,2-diaminopropane in amounts sufficient to resist the coking tendencies of compression ignition fuel compositions when used in the operation of indirect injection diesel engines.

BACKGROUND

Throttling diesel nozzles have recently come into widespread use in indirect injection automotive and light-duty diesel truck engines, i.e., compression ignition engines in which the fuel is injected into and ignited in a prechamber or swirl chamber. In this way, the flame front proceeds from the prechamber into the larger compression chamber where the combustion is completed. Engines designed in this manner allow for quieter and smoother operation.

The FIGURE of the Drawing illustrates the geometry of the typical throttling diesel nozzle (often referred to as the "pintle nozzle").

Unfortunately, the advent of such engines has given rise to a new problem, that of excessive coking on the critical surfaces of the injectors that inject fuel into the prechamber or swirl chamber of the engine. In particular and with reference to the FIGURE, the carbon tends to fill in all of the available corners and surfaces of the obturator 10 and the form 12 until a smooth profile is achieved. The carbon also tends to block the drilled orifice 14 in the injector body 16 and fill up to the seat 18. In severe cases, carbon builds up on the form 12 and the obturator 10 to such an extent that it interfers with the spray pattern of the fuel issuing from around the perimeter of orifice 14. Such carbon build up or coking often results in such undesirable consequences as delayed fuel injection, increased rate of fuel injection, increased rate of combustion chamber pressure rise, and increased engine noise, and can also result in an excessive increase in emission from the engine of unburned hydrocarbons.

While low fuel cetane number is believed to be a major contributing factor to the coking problem, it is not the only relevant factor. Thermal and oxidative stability (lacquering tendencies), fuel aromaticity, and such fuel characteristics as viscosity, surface tension and relative density have also been indicated to play a role in the coking problem.

An important contribution to the art would be a fuel composition which has enhanced resistance to coking tendencies when employed in the operation of indirect injection diesel engines.

THE INVENTION

In accordance with one of its embodiments, this invention provides distillate fuel for indirect injection compression ignition engines containing at least the combination of (a) organic nitrate ignition accelerator, (b) hydrocarbyl amine having from 3 to 60 carbons and from 1 to 10 nitrogens and (c) N,N'-disalicylidene-1,2-diaminopropane, said combination being present in an amount sufficient to minimize coking, especially throttling nozzle coking, in the prechambers or swirl chambers of indirect injection compression ignition engines operated on such fuel.

Another embodiment of the present invention is a distillate fuel additive fluid composition comprising (a) organic nitrate ignition accelerator, (b) hydrocarbyl amine having from 3 to 60 carbons and from 1 to 10 nitrogens and (c) N,N'-disalicylidene-1,2-diaminopropane in an amount sufficient to minimize the coking characteristics of such fuel, especially throttling nozzle coking, in the prechambers or swirl chambers of indirect compression ignition engines operated on such fuel.

Since the invention also embodies the operation of an indirect injection compression ignition engine in a manner which results in reduced coking, a still further embodiment of the present invention is a method of inhibiting coking, especially throttling nozzle coking, in the prechambers or swirl chambers of an indirect injection compression ignition engine, which comprises supplying said engine with a distillate fuel containing at least the combination of (a) organic nitrate ignition accelerator, (b) hydrocarbyl amine having from 3 to 60 carbons and from 1 to 10 nitrogens and (c) N,N'-disalicylidene-1,2-diaminopropane, said combination being present in an amount sufficient to minimize such coking in an engine operated on such fuel.

A feature of this invention is that the combination of additives utilized in its practice is capable of suppressing coking tendencies of fuels used to operate indirect injection compression ignition engines. Such behavior was exhibited in a series of standard engine dynamometer tests conducted as described in Example I hereinafter.

A wide variety of organic nitrate ignition accelerators may be employed in the fuels of this invention. Preferred nitrate esters are the aliphatic or cycloaliphatic nitrates in which the aliphatic or cycloaliphatic group is saturated, contains up to about 12 carbons and, optionally, may be substituted with one or more oxygen atoms.

Typical organic nitrates that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used. The preferred ignition accelerator for use in the fuels of this invention is a mixture of octyl nitrates available as an article of commerce from Ethyl Corporation under the designation DII-3 ignition improver.

The nitrate ignition accelerator—component (a)—should be present in an amount of at least 100 to 1000 PTB (pounds per thousand barrels) of the base fuel. Preferably, the concentration of the ignition accelerator is about 400 to 600 PTB.

While a variety of hydrocarbyl amines may be used in the fuel compositions of this invention, a primary aliphatic amine, the aliphatic group of which is tertiary, e.g., an amine of the formula:

$$R—NH_2$$

wherein R is one or a mixture of tertiary aliphatic groups containing 8 to 18 or more (preferably 12 to 16) carbon atoms is preferred. Most preferably, these tertiary aliphatic groups are tertiary alkyl groups. It is also preferred that hydrocarbyl amine component (b) include in addition to the above-depicted amine one or more hydrocarbyl amines differing therefrom.

U.S. Pat. No. 3,909,215, all disclosure of which is incorporated herein, gives a description of the various hydrocarbyl amines having from 3 to 60 carbons and from 1 to 10 nitrogens which may be employed in the fuels of this invention. A few additional examples of desirable amines include 2,6-di-tert-butyl-α-dimethylamino-p-cresol, N-cyclohexyl-N,N-dimethylamine, and N-alkyl,N,N-dimethylamines in which the alkyl group is one or a combination of alkyl groups preferably having 8 to 18 or more carbon atoms.

A particularly preferred hydrocarbyl amine is available commercially from the Rohm and Haas Company under the designation Primene 81R. The Primene 81R is believed to be a mixture of primary aliphatic amines in which the aliphatic groups are predominantly $C_{12}$ and $C_{14}$ tertiary alkyl groups.

The fuels of this invention should contain at least 40 PTB (pounds per thousand barrels) of component (b), the hydrocarbyl amine, although smaller amounts may be successfully employed.

Component (c) of the fuels of this invention is a metal deactivator. Examples of these are salicylidene-o-aminophenol, disalicylidene ethylenediamine and disalicylidene propylenediamine. A particularly preferred metal deactivator is N,N'-disalicylidene-1,2-diaminopropane (80 weight percent active in 20 weight percent toluene solvent) which is available as an article of commerce from Ethyl Corporation under the designation "Ethyl" MDA.

The fuels of this invention should contain at least 0.2 to 5 PTB of component (d), the metal deactivator, preferably N,N'-disalicylidene-1,2-diaminopropane.

It is not believed that there is anything critical as regards the maximum amount of components (a), (b) and (c) used in the fuel. Thus, the maximum amount of these components will probably be governed in any given situation by matters of choice and economics.

The coking-inhibiting components (a), (b) and (c) of the invention can be added to the fuels by any means known in the art for incorporating small quantities of additives into distillate fuels. Components (a), (b) and (c) can be added separately or they can be combined and added together. It is convenient to utilize additive fluid mixtures which consist of organic nitrate ignition accelerator, hydrocarbyl amine and metal deactivator agents. These additive fluid mixtures are added to distillate fuels. In other words, part of the present invention are coking inhibiting fluids which comprise organic nitrate ignition accelerator, hydrocarbyl amine having from 3 to 60 carbons and from 1 to 10 nitrogens and metal deactivator, preferably N,N'-disalicylidene-1,2-diaminopropane.

Use of such fluids in addition to resulting in great convenience in storage, handling, transportation, blending with fuels, and so forth, also are potent concentrates which serve the function of inhibiting or minimizing the coking characteristics of compression ignition distillate fuels used to operate indirect compression ignition engines.

In these fluid compositions, the amount of components (a), (b) and (c) can vary widely. In general, the fluid compositions contain about 10 to 97.9% by weight of the organic nitrate ignition accelerator component, 2.0 to 75% by weight of the hydrocarbyl amine and 0.1 to 15% by weight metal deactivator. Typically, from about 0.01% by weight up to about 1.0% by weight of the combination will be sufficient to provide good coking-inhibiting properties to the distillate fuel. A preferred distillate fuel composition contains from about 0.1 to about 0.5% by weight of the combination containing from about 50 to about 97.9% by weight of the organic nitrate ignition accelerator, from about 2.0 to about 45% by weight of the hydrocarbyl amine and from about 0.1 to about 5.0% by weight of the metal deactivator component.

The additive fluids, as well as the distillate fuel compositions of the present invention may also contain other additives such as, corrosion inhibitors, antioxidants, metal deactivators, detergents, cold flow improvers, inert solvents or diluents, and the like.

The practice and advantages of this invention will become still further apparent from the following illustrative examples.

EXAMPLE 1

In order to determine the effect of the fuel compositions of the present invention on the coking tendency of diesel injectors in indirect injection compression ignition engines, use was made of a commercial diesel engine operated on a coking test cycle developed by Institute Francais Petrole and as practiced by Peugeot S. A. The amount of coking together with a quantitative indication of the adverse consequences of such coking was determined by means of (i) injector air flow performance, (ii) emission of unburned hydrocarbons, (iii) engine noise, and (iv) injector deposit ratings. The engine employed in the tests was a 1982 Peugeot 2.3 liter, 4-cylinder, turbocharged XD2S diesel engine connected to a Midwest dynamometer through an engine clutch. This engine is equipped with Bosch injectors positioned within prechambers, and is deemed representative of the indirect injection compression ignition engines widely used in automobiles and light-duty trucks.

The base fuel employed in these engine tests was a commercially-available diesel fuel having a nominal cetane rating of 42. FIA analysis indicated the fuel was composed by volume of 31.5% aromatics, 3.0% olefins and 65.5% saturates. Its distillation range (ASTM D-158) was as follows:

| Barometer<br>Initial<br>% Evaporated | 29.46 inches of Hg<br>406° F.<br>at °F. |
|---|---|
| 5 | 439 |
| 10 | 450 |
| 15 | 456 |
| 20 | 463 |
| 30 | 480 |
| 40 | 499 |
| 50 | 521 |
| 60 | 545 |
| 70 | 572 |
| 80 | 603 |
| 85 | 621 |
| 90 | 643 |
| 95 | 678 |
| Final | 678° F. |
| Recovery | 97.5% |
| Residue | 2.5% |
| Loss | None |

Other inspection data on the base fuel were as follows:

| | |
|---|---|
| Kinematic Viscosity, (ASTM D-445) | 3.50 Centistokes, 40° C. |
| Pour Point (ASTM D-97) | −26° C. |
| Cloud Point (ASTM D-97) | 33° C. |
| Flash Point (ASTM D-93) | 91° C. |
| Steam Jet Gum | 2.4 mg/100 ml |
| Aniline Point (ASTM D-611) | 143.4° F. |
| Total Sulfur | 0.41 wt. % |
| Ramsbottom Carbon, % (ASTM D-524) | 0.1460 on 10% Residuum |
| Gravity (ASTM D-287) | 31.8 °API |
| Specific Gravity @ 25° C. | 0.86 |
| Cetane rating | 41 |

A test blend was prepared from this base fuel (Fuel A). Fuel A contained a combination of (i) 506 PTB of mixed octyl nitrates (a commercial product available from Ethyl Corporation under the designation DII-3 Ignition Improver), (ii) 13.2 PTB of a hydrocarbyl amine available commercially from Rohm and Haas Company under the designation Primene 81R and (iii) 1.7 PTB of "Ethyl" Metal Deactivator, a product of Ethyl Corporation, the active ingredient of which is N,N'-disalicylidene-1,2-diaminopropane.

The manufacturer gives the following typical properties for its "Ethyl" Metal Deactivator:

| | |
|---|---|
| Form | Liquid |
| Color | Amber |
| Density, at 68° F. | |
| g/ml | 1.0672 |
| lb/gal | 8.91 |
| Active ingredient, wt % | 80 |
| Solvent vehicle (toluene), wt % | 20 |
| Flash point, open cup, °F. | 84 |
| Fire point, °F. | 100 |
| Solubility | |
| In gasoline (Typical) | Saturated solution contains 94% MDA |
| In water, wt. % | 0.04 |

The Primene 81R is believed to be a mixture of primary aliphatic amines in which the aliphatic groups are predominantly $C_{12}$ and $C_{14}$ tertiary alkyl groups.

Shell Rotella T, an SAE 30, SF/CD oil was used as the crankcase lubricant.

Before starting each test, new Bosch DNOSD-1510 nozzles were installed using new copper gaskets and flame rings. The fuel line was flushed with the new test fuel composition to be tested and the fuel filter bowl and fuel return reservoir were emptied to avoid additive carry-over from test-to-test.

At the start of each test, the engine was operated at 1000 rpm, light load for 15 minutes. After this warm-up, the engine was subjected to the following automatic cycle:

| Event | RPM | Beam Load | Minutes | EGR |
|---|---|---|---|---|
| 1 | 750 | 0 | 4 | off |
| 2 | 2750 | 12.0 | 6 | on |
| 3 | 1500 | 6.2 | 6 | on |
| 4 | 4000 | 16.2 | 4 | off |

The above 20-minute cycle was repeated 60 times and the test was completed by running the engine at idle for another 30 minutes. The total elapsed time was thus 20.5 hours per test.

When passing from one event to the next event in the above cycle, some time, of course, was required to enable the engine to accelerate or decelerate from one speed to the next. Thus, more specifically, the above cycle was programmed as follows:

| Segment | Seconds | rpm | Beam Load |
|---|---|---|---|
| 1 | 2 | 750 | 0 |
| 2 | 200 | 750 | 0 |
| 3 | 3* | 2500 | 12 |
| 4 | 7* | 2750 | 12 |
| 5 | 350 | 2750 | 12 |
| 6 | 3* | 2275 | 6.2 |
| 7 | 7* | 1500 | 6.2 |
| 8 | 330 | 1500 | 6.2 |
| 9 | 3* | 3500 | 16.2 |
| 10 | 7* | 4000 | 16.2 |
| 11 | 230 | 4000 | 16.2 |
| 12 | 3* | 2000 | 0 |
| 13 | 7* | 750 | 0 |
| 14 | 30 | 750 | 0 |

*Represents two mode periods for acceleration or deceleration to the next condition.

Hydrocarbon exhaust emissions were measured at the start of each test (after the first 20-minute cycle), at the 6-hour test interval and at the end of the test. These measurements were made at 750, 1000, and 1400 rpm idle. Noise level readings were made at a location three feet from the engine exhaust side. The measurements were made at the start and at the end of the test while operating at three idle speeds, viz., 750, 1000 and 1400 rpm.

After the test operation, the injectors were carefully removed from the engine so as not to disturb the deposits formed thereon. Measurements were made of air flow through each nozzle at different pintle lifts, and pintle deposits were rated using the CRC deposit rating system.

The most significant test results are given in Table I, in which air flow is expressed as cc/min and hydrocarbon emissions as ppm.

TABLE 1

| Fuel | Air Flow @ 0.1 mm Lift | Pintle Obturator Deposits (10 = clean) | Noise, DB EOT* | Noise, DB INCR. | Hydrocarbon Emissions EOT* | Hydrocarbon Emissions Incr. |
|---|---|---|---|---|---|---|
| Base | 36 | 8.0 | 83.8 | 3.0 | 577 | 406 |
| A | 49 | 8.4 | 81.3 | 2.2 | 282 | 51 |

*Value at end of test; the increase (Incr.) shown is in comparison to the value at start of test.

The results presented in Table I show that there were less coking deposits (higher air flow rate and fewer deposits), less engine noise and less hydrocarbon emissions from Fuel A, the fuel of the invention, as compared to the Base Fuel.

I claim:

1. Distillate fuel for indirect injection compression ignition engines containing at least the combination of (a) organic nitrate ignition accelerator, (b) hydrocarbyl amine having from 3 to 60 carbons and from 1 to 10 nitrogens and (c) N,N'-disalicylidene-1,2-diaminopropane, said combination being present in an amount sufficient to minimize coking on the nozzles of indirect injection compression ignition engines operated on such fuel.

2. The composition of claim 1 wherein said ignition accelerator is a mixture of octyl nitrates.

3. The composition of claim 1 wherein said hydrocarbyl amine is comprised of alkyl amine of the formula $R—NH_2$ wherein R is one or a mixture of tertiary alkyl groups containing 8 to 18 or more carbon atoms.

4. The composition of claim 3 wherein R is one or a mixture of tertiary alkyl groups containing 12 to 16 carbon atoms.

5. A method of inhibiting coking on the injector nozzles of indirect injection compression ignition engines which method comprises supplying said engine with a distillate fuel containing at least the combination of (a) organic nitrate ignition accelerator, (b) hydrocarbyl amine having from 3 to 60 carbons and from 1 to 10 nitrogens and (c) N,N'-disalicylidene-1,2-diaminopropane, said combination being present in an amount sufficient to minimize such coking in the engine operated on such fuel.

6. The method of claim 5 wherein said ignition accelerator is a mixture of octyl nitrates.

7. The method of claim 5 wherein said hydrocarbyl amine is comprised of alkyl amines of the formula $$R—NH_2$$

wherein R is one or a mixture of tertiary alkyl groups containing 8 to 18 or more carbon atoms.

8. The method of claim 7 wherein R is one or a mixture of tertiary alkyl groups containing 12 to 16 carbon atoms.

9. An additive fluid concentrate for use in distillate fuels comprising at least the combination of (a) organic nitrate ignition accelerator, (b) hydrocarbyl amine having from 3 to 60 carbons and from 1 to 10 nitrogens and (c) N,N'-di-salicylidene-1,2-diaminopropane.

10. A concentrate of claim 9 wherein said ignition accelerator is a mixture of octyl nitrates.

11. A concentrate of claim 9 wherein said hydrocarbyl amine is comprised of alkyl amine of the formula $$R—NH_2$$

wherein R is one or a mixture of tertiary alkyl groups containing 8 to 18 or more carbon atoms.

12. A concentrate of claim 9 comprising from about 10 to 97.9% by weight of said organic nitrate ignition accelerator, 2.0 to 75% by weight of said hydrocarbyl amine and 0.1 to 15% by weight of said N,N'-di-salicylidene-1,2-diaminopropane.

* * * * *